US006357362B1

(12) United States Patent
Krbec et al.

(10) Patent No.: US 6,357,362 B1
(45) Date of Patent: Mar. 19, 2002

(54) APPARATUS TO ACCOMMODATE GROUND LEVEL AND PLATFORM BOARDING OF A TRANSIT VEHICLE

(75) Inventors: Marianne L. Krbec, Elmhursts; Robert L. Oakley, Chicago, both of IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 09/715,319

(22) Filed: Nov. 17, 2000

Related U.S. Application Data

(60) Provisional application No. 60/166,447, filed on Nov. 19, 1999.

(51) Int. Cl.[7] ..... B60R 3/00

(52) U.S. Cl. ..... 105/343; 105/426; 105/329.1

(58) Field of Search ..... 105/329.1, 341, 105/343, 426, 427, 429, 430, 436; 104/27, 28, 30; 296/155; 280/166

(56) References Cited

U.S. PATENT DOCUMENTS 5,070,794 A * 12/1991 Kunst et al. ..... 105/436
6,263,804 B1 * 7/2001 Rizk ..... 105/243

* cited by examiner

*Primary Examiner*—Mark T. Le
(74) *Attorney, Agent, or Firm*—James Ray & Associates

(57) ABSTRACT

A door system for a transit vehicle provided with a door opening has a full height sliding door for covering and uncovering the door opening, and a threshold which is disposed within the sliding door when the sliding door is closed. The threshold is positioned at substantially the elevation of the floor. A retention mechanism is attached to the threshold, the retention mechanism is activated when the trap door is in the deployed position to engage the trap door and release the sliding door so that when the sliding door is opened, the threshold is retained to fill a gap between the trap door and the platform. When the trap door is in the stowed position, the retention mechanism disengages the trap door and engages the sliding door so that the threshold moves with the sliding door and does not interfere with street level street level boarding.

18 Claims, 13 Drawing Sheets

APPARATUS TO ACCOMMODATE GROUND LEVEL AND PLATFORM BOARDING OF A TRANSIT VEHICLE

CROSS REFERENCE TO RELATED APPLICATION

The invention described in this patent application is closely related to the following copending United States provisional patent application: APPARATUS TO ACCOMMODATE LOW FLOOR AND PLATFORM BOARDING OF A TRANSIT VEHICLE, Serial No. 60/166,447. That application was filed on Nov. 19, 1999. Its teachings are hereby incorporated into the present application by reference thereto.

FIELD OF THE INVENTION

The present invention relates, in general, to door systems for transit vehicles and, more particularly, the instant invention relates to door systems for ground level and platform boarding.

BACKGROUND OF THE INVENTION

Transit vehicles are required which provide for passenger boarding and discharging from either an elevated platform or from ground level. Such a vehicle has a stairway leading downward from the floor of the vehicle to an elevation close to the ground, so that passengers are enabled to board from ground level, or to exit to ground level. The vehicle also has a moveable trap door which may be placed in a deployed position in which it covers the stairway and acts as a bridge permitting passengers to exit to a platform.

A prior art door system for such a vehicle is described in U.S. Pat. No. 5,070,794. That patent describes a vehicle having a door with an upper section and a lower section. It has a trap door which is pivotally mounted beside the stairway and is rotated downward to cover the stairway for platform boarding. In that patent, the trap door is referred to as a stairwell platform. In the case of platform boarding, only the upper section of the door is opened. The lower section of the door remains in its closed position. The lower section of the door has a threshold along its upper edge, the threshold bridging a gap between the trap door and the platform. The floor of the transit vehicle, the trap door, the threshold and the platform are all at substantially the same level.

For loading and discharging passengers at ground level, the trap door is rotated upward so that the stairway is uncovered. Then, when the door is opened, the lower section of the door moves with the upper section so that the lower section does not prevent passengers from exiting and entering the transit vehicle.

This type of door requires slide rails for both the upper and lower sections of the door. It also requires a lock to connect the lower section to the upper section so the lower section moves with the upper section during ground level boarding.

SUMMARY OF THE INVENTION

The present invention is a door system for a transit vehicle having a vehicle body with a full height door opening, which is for alternatively boarding from ground level and boarding from a platform. The transit vehicle has a floor, a stairway for ground level boarding and a trap door positionable in a deployed position for covering the stairway for platform boarding. The trap door is also positionable in a stowed position not covering the stairway for ground level boarding. The door system has a full height sliding door for covering and uncovering the door opening and a threshold which is disposed within the sliding door when the sliding door is closed. The threshold is positioned at substantially the elevation of the floor. A retention mechanism is attached to the threshold, the retention mechanism is activated when the trap door is in the deployed position to engage the trap door and release the sliding door so that when the sliding door is opened, the threshold is retained to fill a gap between the trap door and the platform. When the trap door is in the stowed position, the retention mechanism disengages the trap door and engages the sliding door so that the threshold moves with the sliding door and does not interfere with street level street level boarding.

OBJECTS OF THE INVENTION

It is therefore one of the primary objects of the present invention to provide a door system for a transit vehicle which provides, alternatively, for boarding from a platform or from ground level.

It is a further object of the present invention to provide a transit vehicle door system for, alternatively, platform boarding or ground level boarding in which the door system has a single full height door which is moved between an open position and a closed position.

Still another object of the present invention is to provide a transit vehicle door system for, alternatively, platform boarding or ground level boarding in which the door system includes a single full height door which is moved between an open position and a closed position and wherein the system has a threshold for covering a gap between a trap door and a platform during platform boarding.

Yet another object of the present invention is to provide a transit vehicle door system for platform boarding or ground level boarding which does not require two independently moving door panels.

A further object of the present invention is to provide a transit vehicle door system for platform boarding or ground level boarding which does not require support rails for independently moving door panels.

An additional object of the present invention is to provide a transit vehicle door system for platform boarding or ground level boarding having a full height door with a threshold disposed within the door in which the threshold is retained so it stays in position and does not move with the door during platform boarding.

Still yet another object of the present invention is to provide a transit vehicle door system for platform boarding or ground level boarding having a threshold which is retained in place when the trap door is in position for platform boarding.

Yet still another object of the present invention is to provide a threshold for a transit vehicle door system having a heater for removal of ice.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

Figure 1:
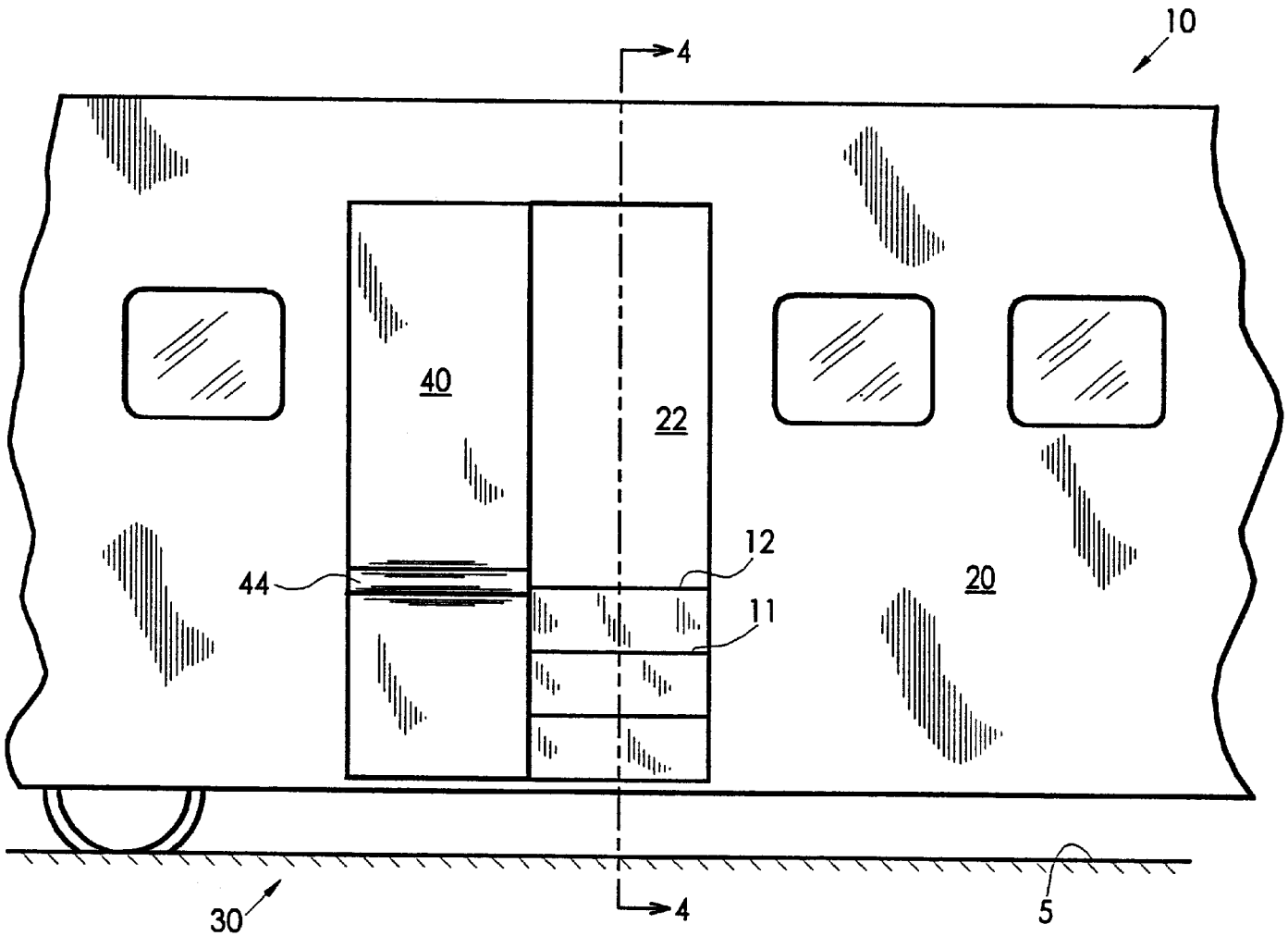
FIG. 1 is a schematic elevation view of a transit vehicle having a full height door which is open for ground level boarding.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures for the sake of clarity and understanding of the invention.

Attention is now directed to the figures, which illustrate the presently preferred embodiment of the invention. FIG. 1 shows a transit vehicle, generally designated 10, having a vehicle body, generally designated 20. Vehicle body 20 has a door opening 22 and a stairway 11 leading down from vehicle floor 12 to ground level 5. A door system, generally designated 30, includes a sliding door, generally designated 40, which is shown in an open position. Rails, or rods, for support of sliding door 40 are not shown.

Figure 2:
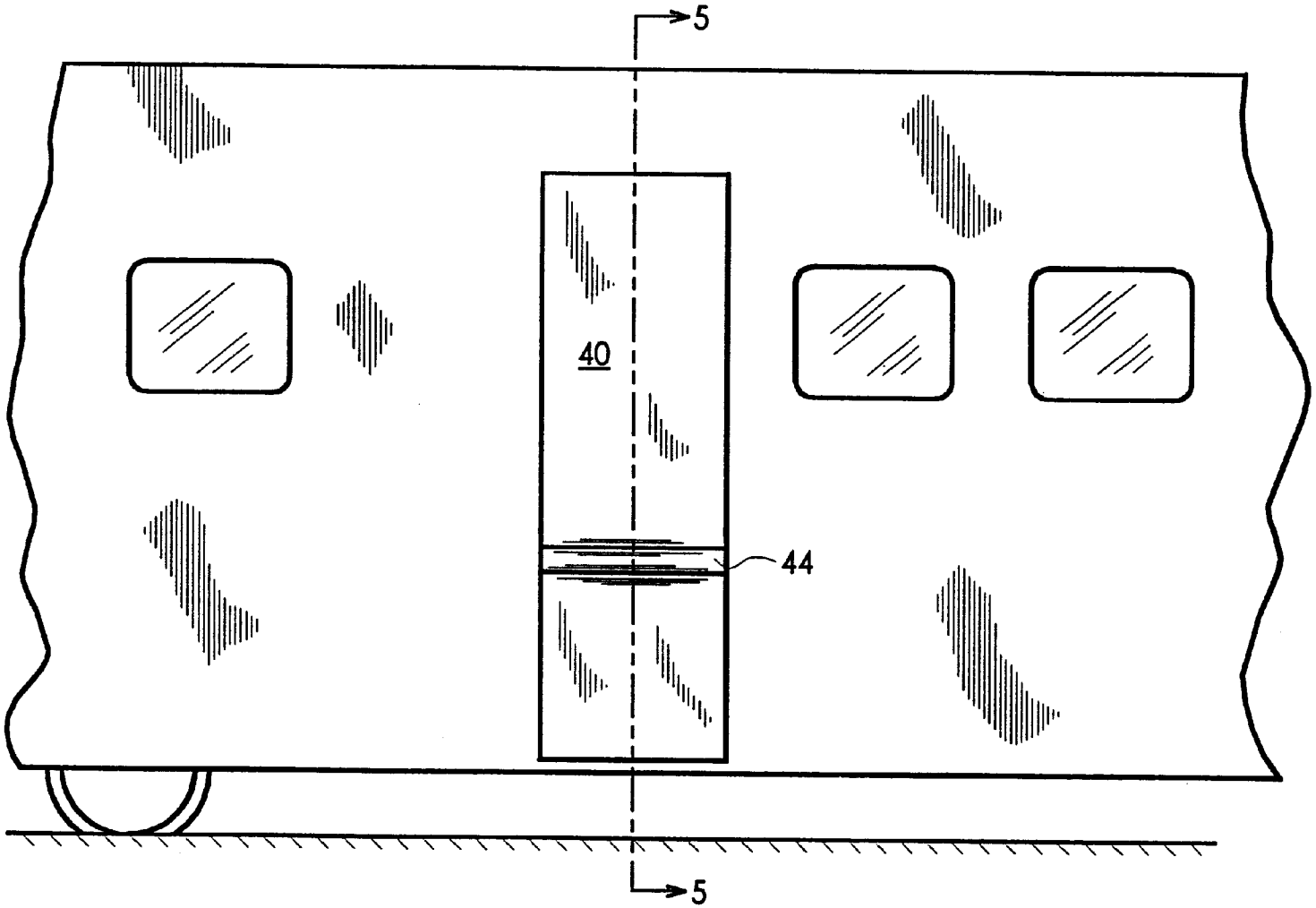
FIG. 2 is a schematic elevation view of the transit vehicle of FIG. 1 with the door in a closed position.
Figure 3:
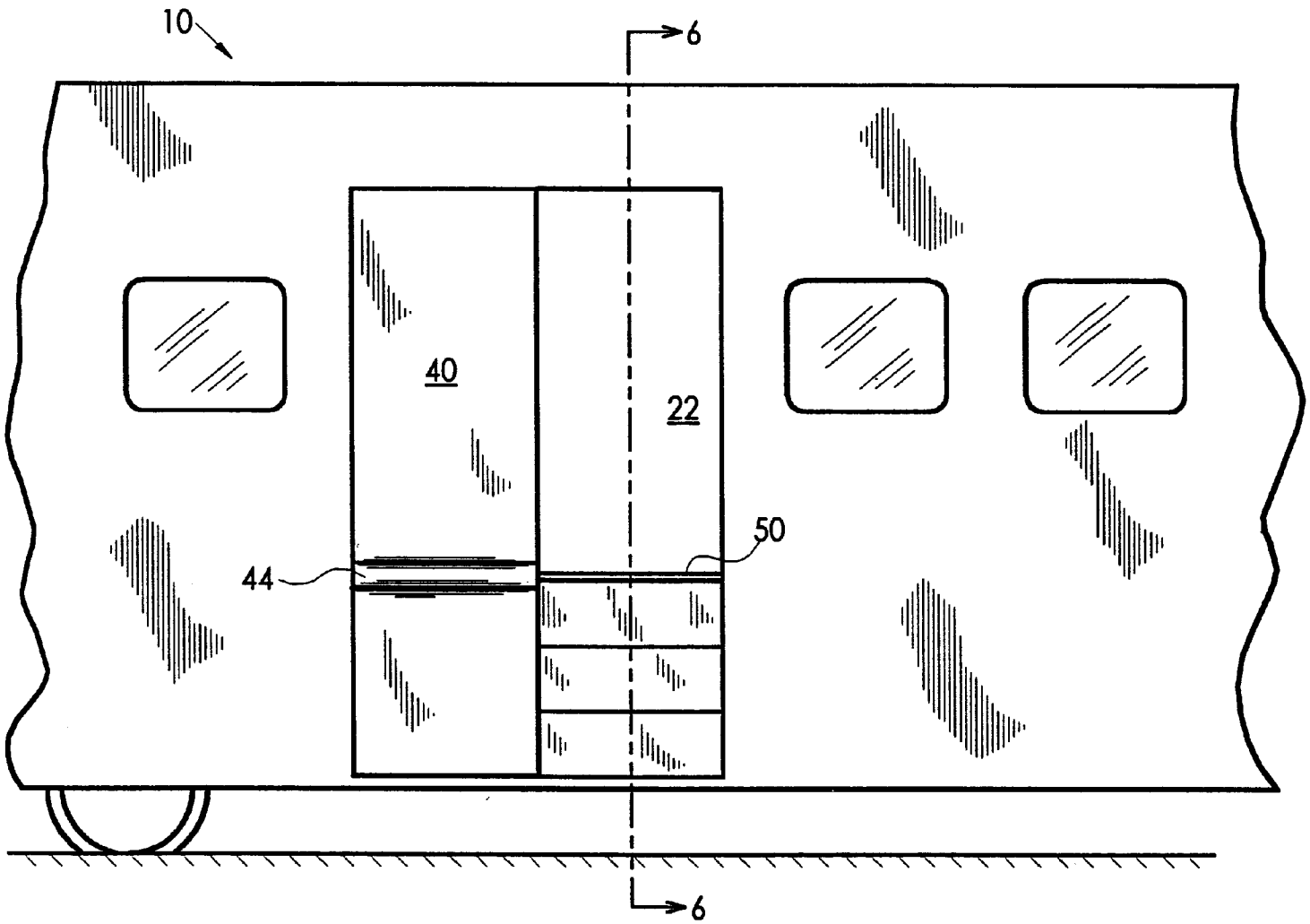
FIG. 3 is a schematic elevation view of the transit vehicle shown in FIGS. 1 and 2 with the door open and a threshold in position for platform boarding.

FIG. 2 illustrates the transit vehicle 10 with the sliding door 40 in its closed position. FIG. 3 illustrates the transit vehicle 10 with the sliding door 40 in an open position and a threshold 50 being positioned for platform boarding. Normally, FIG. 3 would not be seen because the platform would cover the lower portion of vehicle 10. When sliding door 40 is in the closed position shown in FIG. 2, or is opened for ground level boarding as in FIG. 1, threshold 50 is contained within a horizontal pocket 44 in sliding door 40.

Figure 4:
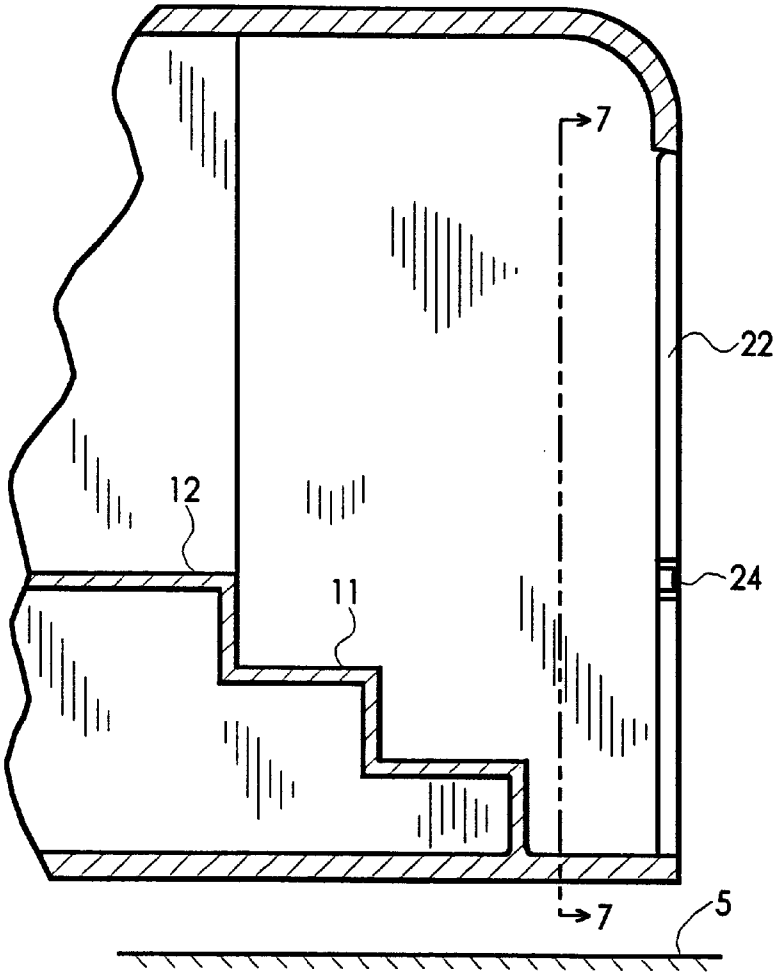
FIG. 4 is a section cut along line 4—4 of FIG. 1, which is for ground level boarding.

FIG. 4 is a section cut along line 4—4 in FIG. 1. It illustrates the floor 12 of transit vehicle 10, and a stairway 11 leading down through door opening 22 to ground level 5. In this configuration, vehicle 10 is configured for ground level boarding.

Figure 5:
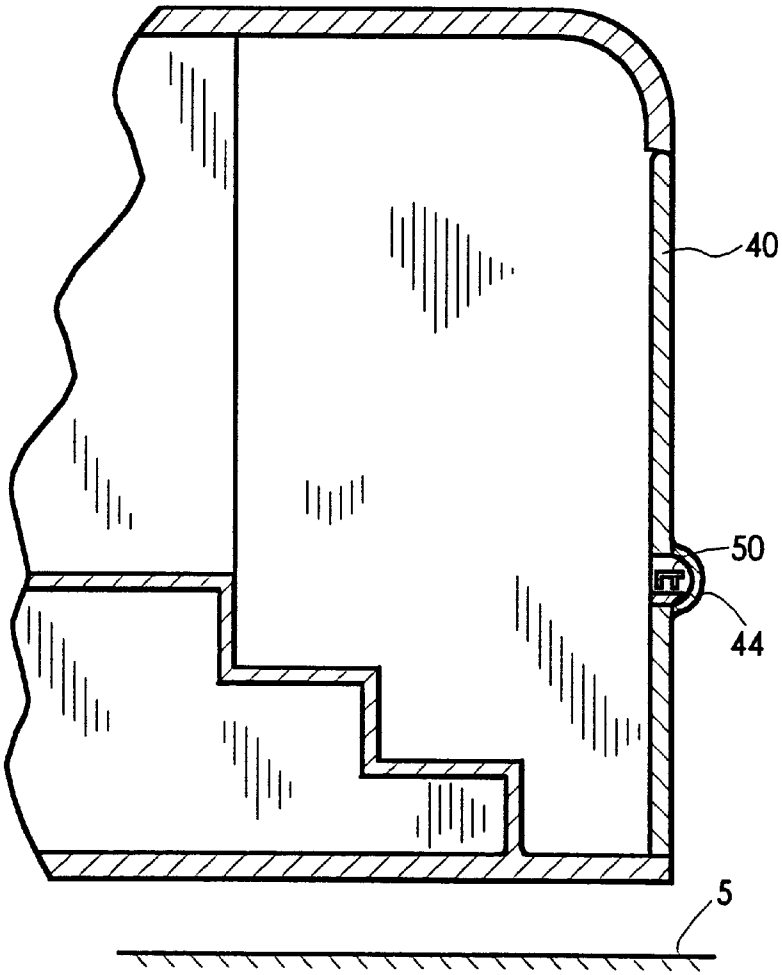
FIG. 5 is a section cut along line 5—5 of FIG. 2, the door being closed.

FIG. 5 is a section cut along line 5—5 of FIG. 2. It shows sliding door 40 in a closed position. Sliding door 40 has a horizontal pocket 44 enclosing threshold 50.

Figure 6:
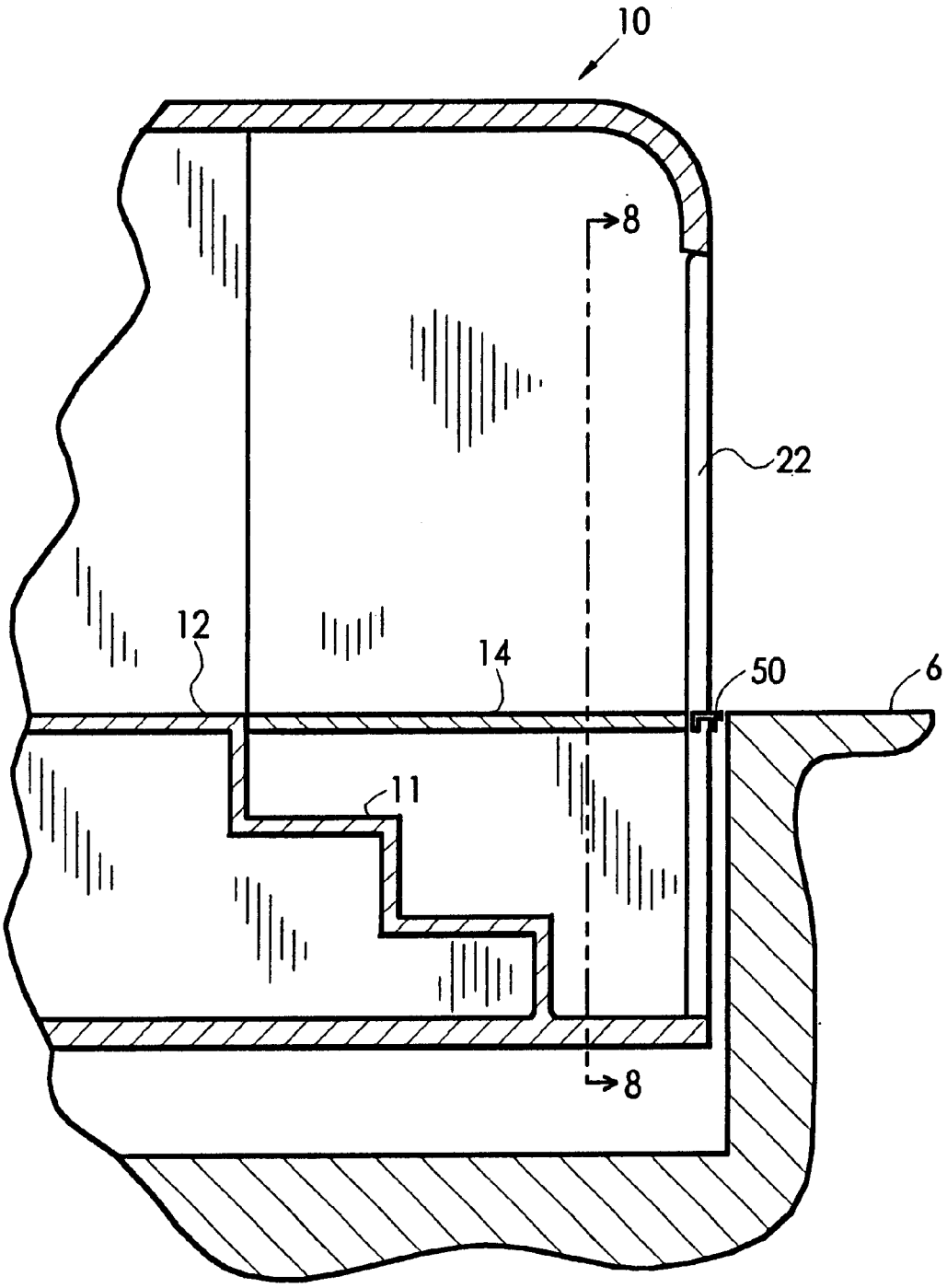
FIG. 6 is a section cut along line 6—6 of FIG. 3, showing a trap door and threshold in position for platform boarding.

FIG. 6 is a section cut along line 6—6 of FIG. 3. It illustrates transit vehicle 10 configured for platform boarding. A trap door 14 has been deployed to cover the stairway 11. Trap door 14 is substantially level with floor 12 and platform 6. This figure illustrates threshold 50 positioned across door opening 22 to cover a gap (best seen in FIG. 9) between trap door 14 and platform 6.

Figure 7:
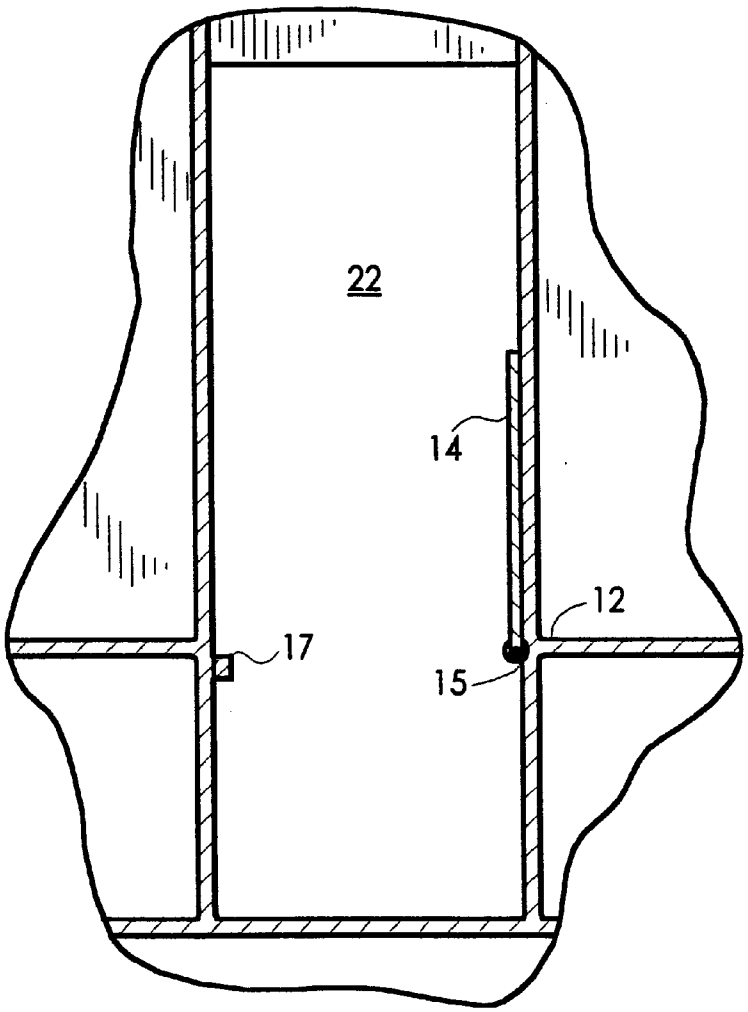
FIG. 7 is a section cut along line 7—7 of FIG. 4 showing the trap door lifted for ground level boarding.

FIG. 7 is a section cut along line 7—7 in FIG. 4. It shows trap door 14 rotated upward about its hinge 15 so it does not cover door opening 22, thus enabling ground level boarding.

Figure 8:
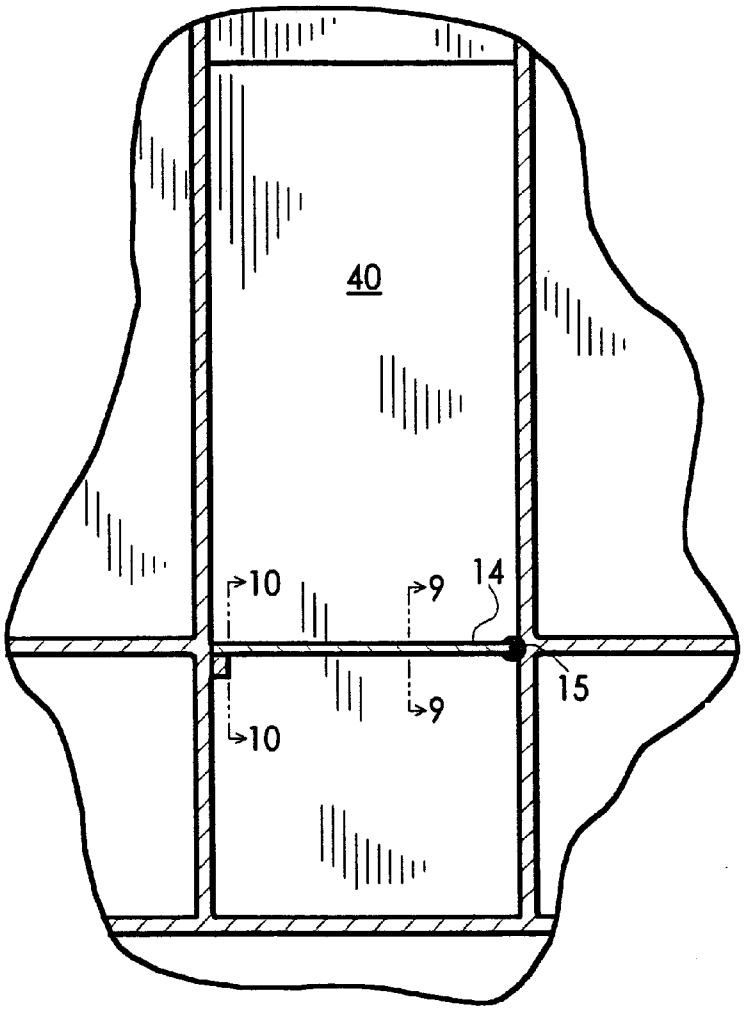
FIG. 8 is a section cut along line 8—8 of FIG. 6 showing the trap door deployed for platform boarding.

FIG. 8 is a section cut along line 8—8 in FIG. 6. It illustrates trap door 14 rotated downward about hinge 15 to enable platform boarding upon the next opening of sliding door 40. Trap door 14 is supported on support 17, best seen in FIG. 7.

Figure 9:
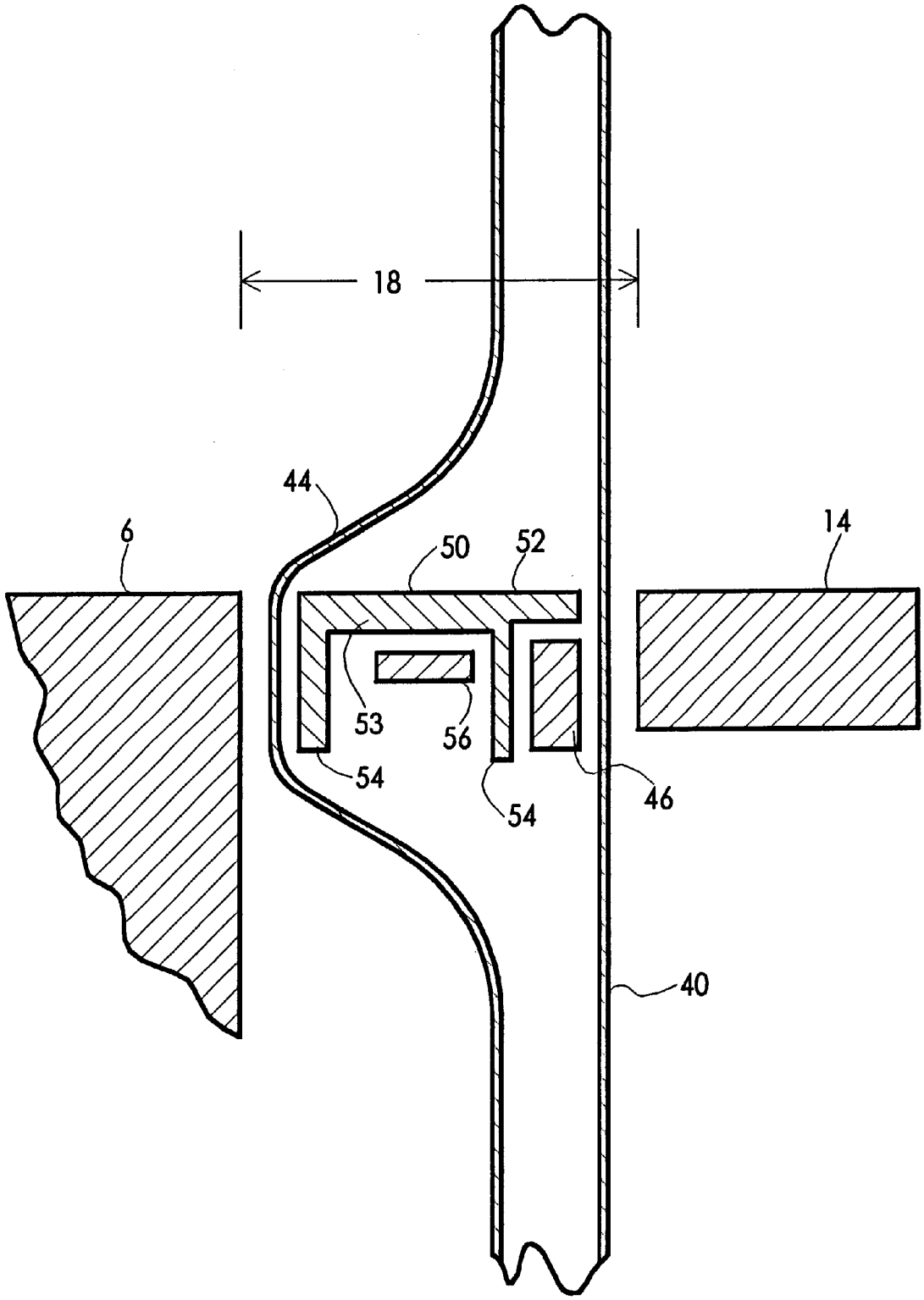
FIG. 9 is a section cut along line 9—9 of FIG. 8 showing the threshold in a pocket in the sliding door.

FIG. 9 is a section cut along line 9—9 of FIG. 8. It shows threshold 50 contained within horizontal pocket 44 in sliding door 40. Sliding door 40 includes support 46, which is for supporting and guiding threshold 50. Threshold 50 has a top surface 52 at the same level as that of the trap door 14 and platform 6. It serves to cover gap 18 between trap door 14 and platform 6. Threshold 50 includes a top flange 53 and, preferably, it has a heater 56 for melting snow and/or ice during winter months. Preferably, the heater 56 is disposed between stiffening ribs 54 of threshold 50.

Figure 10:
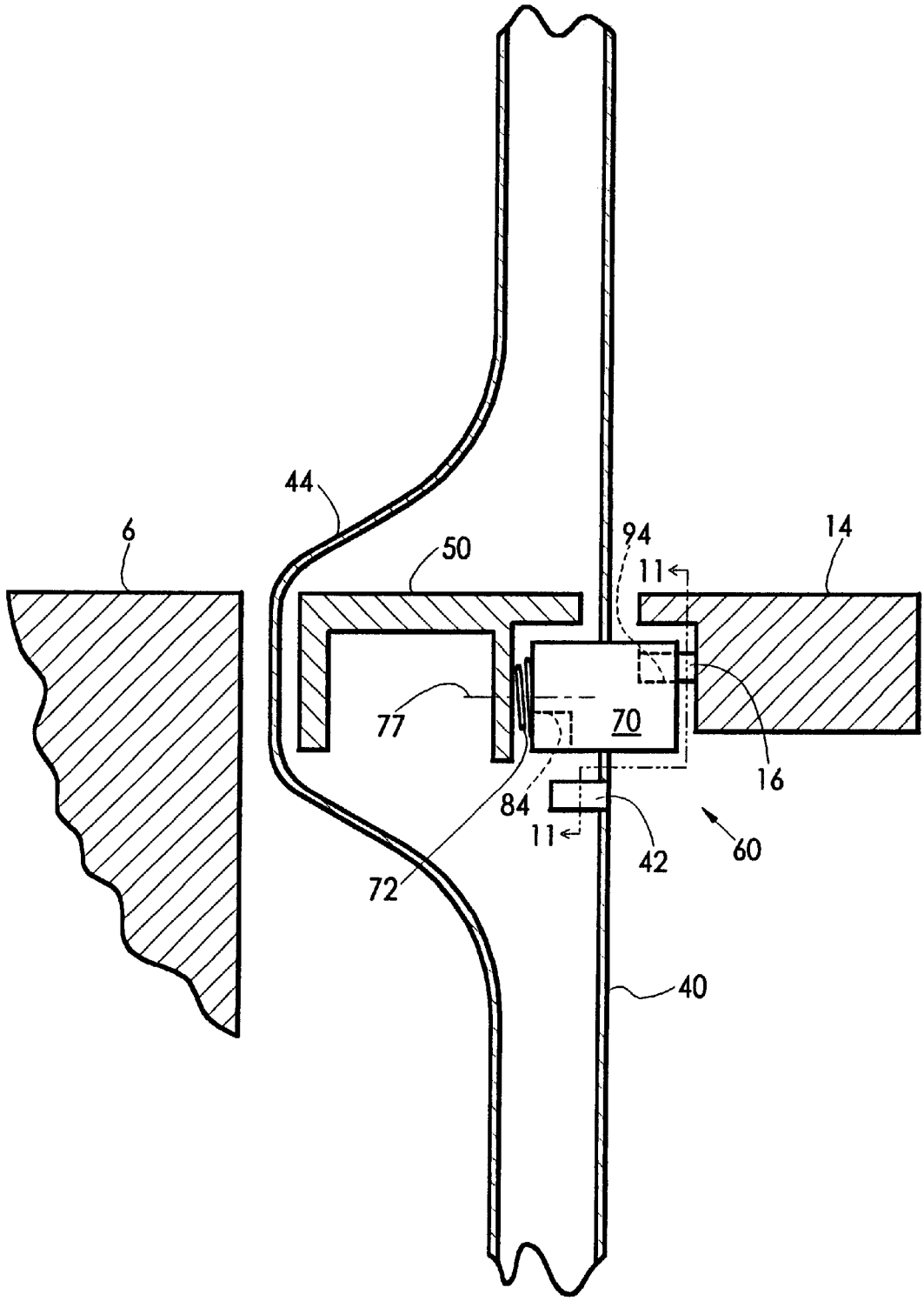
FIG. 10 is a section cut along line 10—10 of FIG. 8 showing elements of the retention mechanism.

FIG. 10 is a section cut along line 10—10 of FIG. 8. It shows a retention mechanism, generally designated 60, for retaining threshold 50 in place when sliding door 40 is opened. Retention mechanism 60 includes a latch 70, a pin 16 attached to trap door 14 and a pin 42 attached to sliding door 40.

Figure 11:
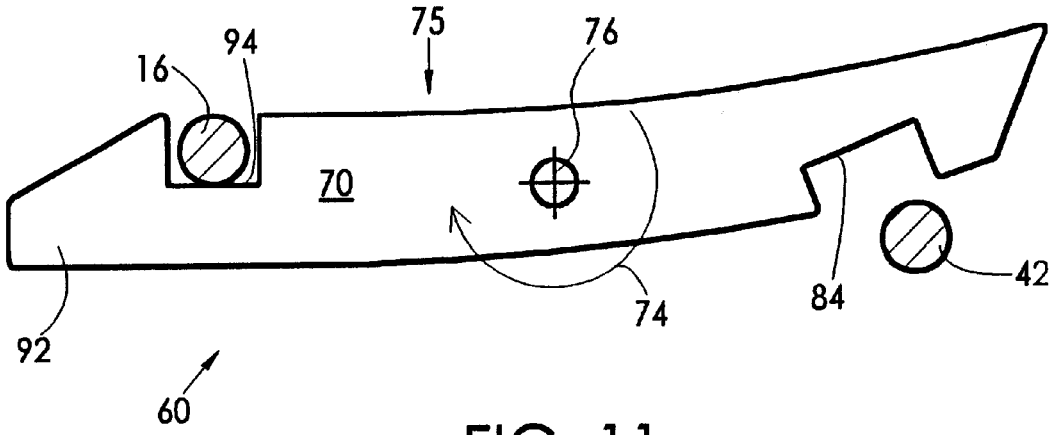
FIG. 11 is a section cut along line 11—11 of FIG. 10 showing the latch engaging a pin on the trap door so the threshold is retained in position for platform boarding.
Figure 12:
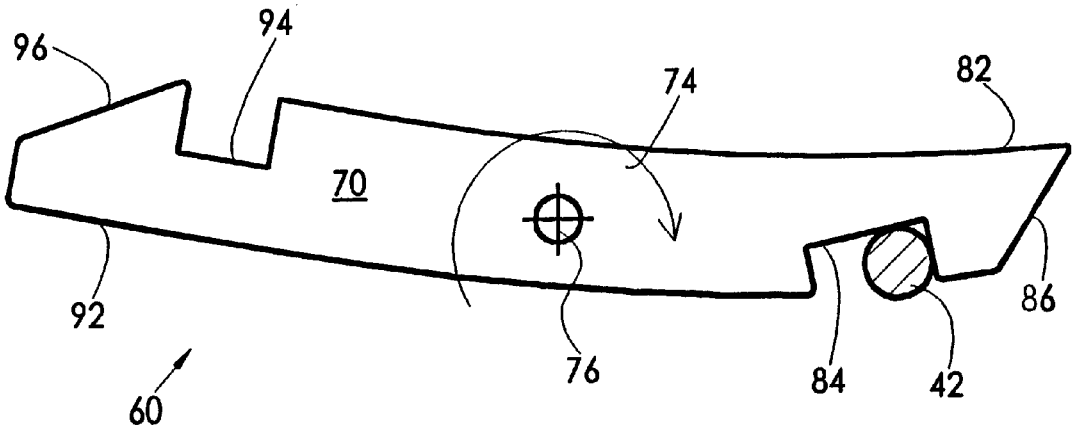
FIG. 12 is a view of the latch engaged to a pin on the sliding door, so when the door is opened for ground level boarding, the threshold moves with the sliding door.

FIG. 11 is a view of the latch 70 taken from the line indicated as 11—11 in FIG. 10 (when trap door 14 is deployed), and FIG. 12 is a similar view of latch 70 when trap door 14 has been removed. Latch 70 has a pivot 76 having a pivot axis 77, which was shown in FIG. 10. Pivot 76 is located in central portion 75 of latch 70. A torsion spring 72, shown in FIG. 10, biases latch 70 to rotate in the direction 74, shown in FIGS. 11 and 12. Latch 70 has a sliding door engaging end 82 having a sliding door engaging notch 84, which is for capturing pin 42 on sliding door 40. Latch 70 further has a trap door engaging end 92 having a trap door engaging notch 94, which is for capturing pin 16 on trap door 14.

The bias direction 74 of torsion spring 72 tends to rotate latch 70 into engagement with both pin 42 on sliding door 40 and pin 16 on trap door 14. However, when trap door 14 is deployed, pin 16 causes latch 70 to rotate counter to bias direction 74 so that pin 42 on sliding door 40 is released, as shown in FIG. 11.

When the trap door 14 is removed, the pin 16 is removed with it. This permits the torsion spring 72 to rotate the latch 70 into the bias direction 74 so that the pin 42 on such sliding door 40 is captured in sliding door engaging notch 84.

FIGS. 11 and 12 illustrate the operation of latch 70. When the trap door 14 is deployed, as in FIG. 11, the latch 70 and hence the threshold 50 are kept in place, so that when the sliding door 40 is opened, threshold 50 remains in position to cover gap 18 between trap door 14 and platform 6.

When the trap door 14 is removed, latch 70 rotates as shown in FIG. 12 so that latch 70 captures pin 42 on sliding door 40 and moves with sliding door 40 to enable ground level boarding.

Figure 13:
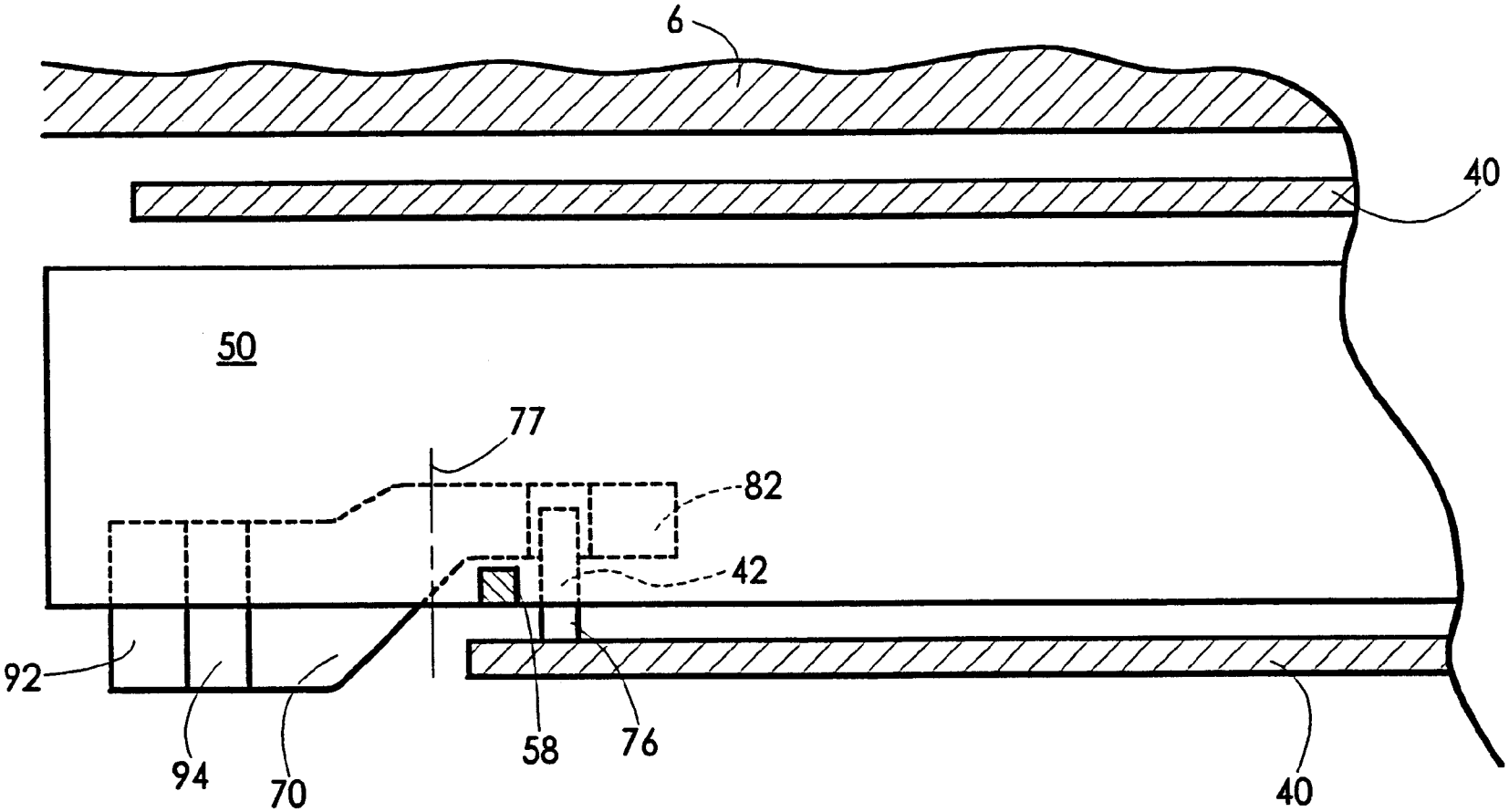
FIG. 13 is a top view of the latch.

FIG. 13 illustrates latch 70, viewed from above. Trap door engaging end 92 of latch 70 is thickened inwardly, as shown, so that trap door engaging notch 94 can capture pin 16 on trap door 14.

Figure 14:
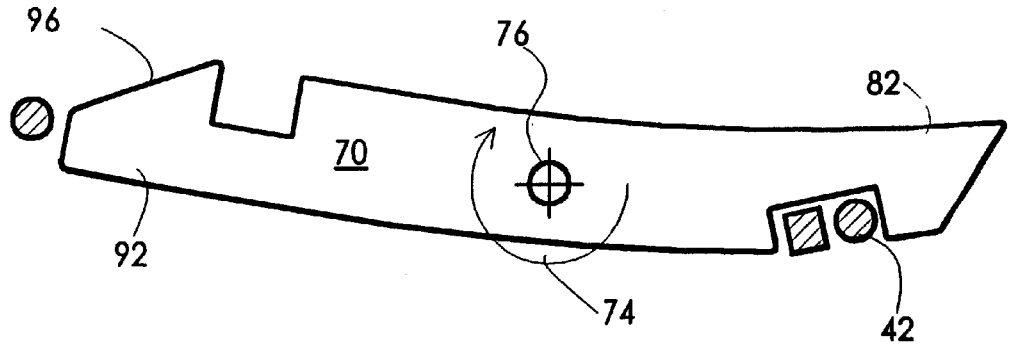
FIG. 14 is a view the latch when the sliding door has been opened for ground level boarding, the trap door has been deployed, and the door is being closed.
Figure 15:
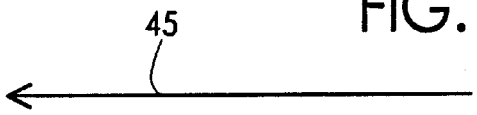
FIG. 15 is a view of the latch engaging the pin on the trap door when the sliding door has been opened, the trap door deployed, and the door is being closed.
Figure 15:
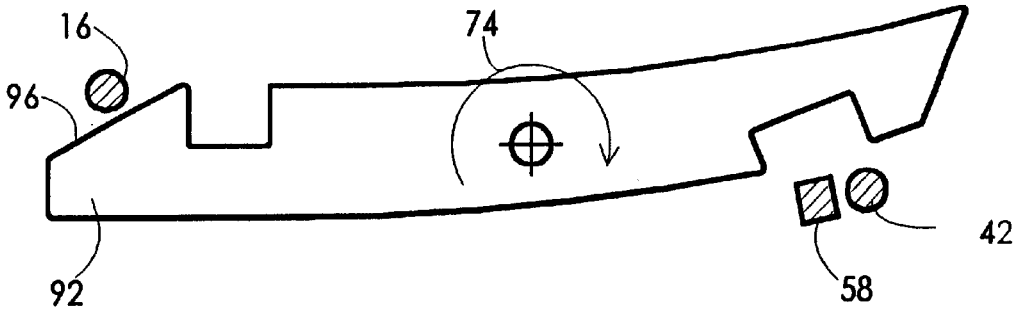
Figure 16:
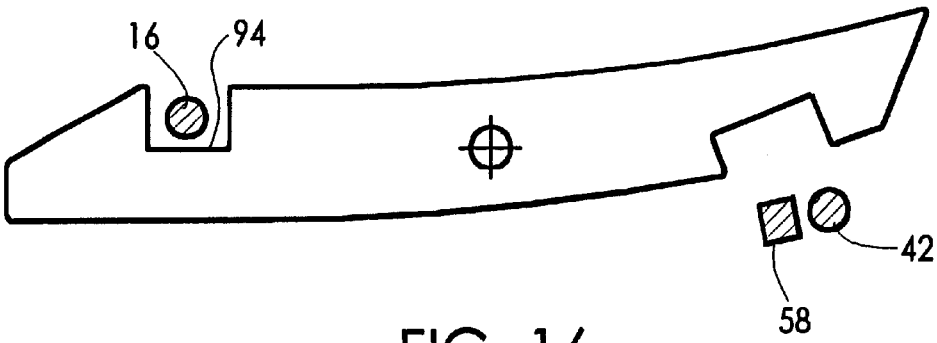
FIG. 16 is a view of the latch engaged with the pin on the trap door when the trap door is deployed and the sliding door is closed.

FIGS. 14, 15 and 16 illustrate a preferred feature of the invention. An oblique striker surface 96, preferably, is provided on the trap door engaging end 92 of latch 70. Oblique striker surface 96 provides for a situation in which sliding door 40 has been open for ground level boarding and trap door 14 is deployed in anticipation of a subsequent stop at a platform 6, before sliding door 40 is closed.

In these figures, trap door 14 (not shown in these figures) has been lowered, so that pin 16 is positioned as shown. FIG. 14 illustrates the latch 70, which is moving in the door closing direction 45. In FIG. 15, oblique striker surface 96 on the trap door engaging end 92 of latch 70 has contacted a pin 16 so that the latch 70 rotates counter to bias direction 74 of torsion spring 72, thereby disengaging latch 70 from pin 42 on sliding door 40.

Latch 70, which is attached to threshold 50, continues to move in door closing direction 45 because pin 42 on sliding door 40 contacts push surface 58, which is attached to threshold 50.

In FIG. 16, the sliding door 40 has moved all the way to the closed position and the latch 70 has captured the pin 16 on trap door 14, so that at the subsequent station, having a platform 6, the threshold 50 will be retained in the position as shown in FIGS. 3 and 6.

Figure 17:
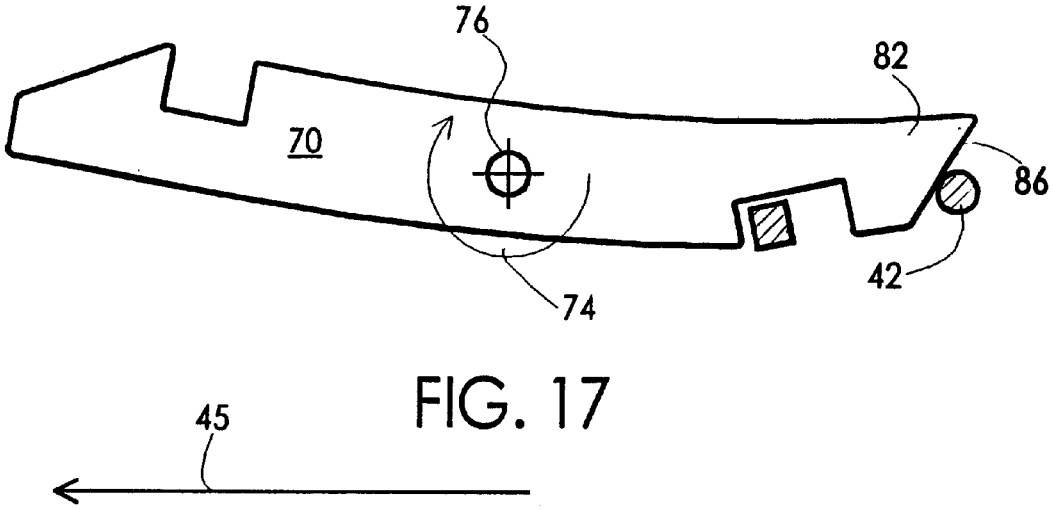
FIG. 17 is a view of the latch when the sliding door has been opened for platform boarding, the trap door has been removed, and the sliding door is being closed.
Figure 18:
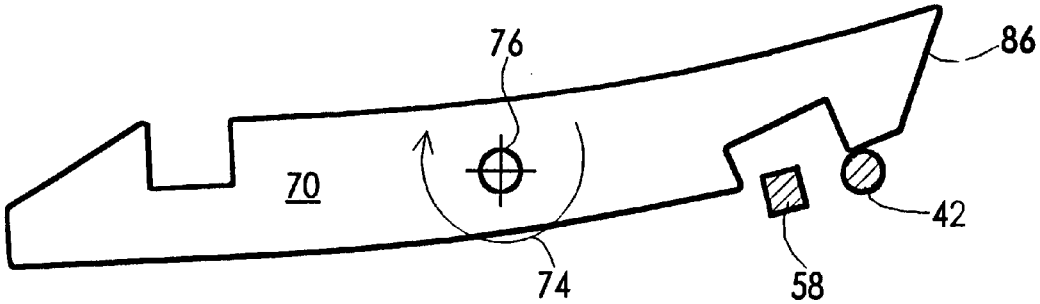
FIG. 18 is a view of the latch when the pin on the sliding door has rotated the latch to permit the pin on the sliding door to be captured by the latch.
Figure 19:
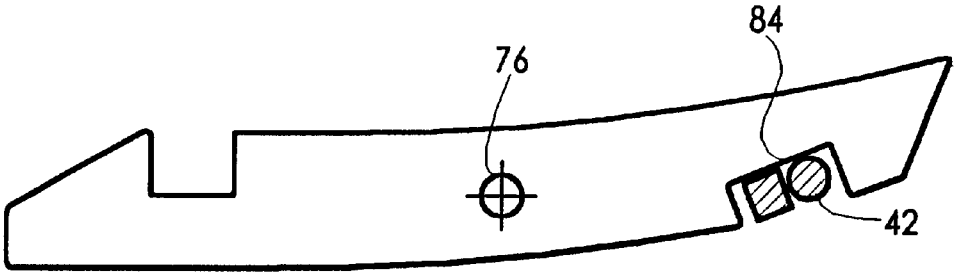
FIG. 19 is a view of the latch engaged with the pin on the sliding door.

FIGS. 17, 18 and 19 illustrate a preferred feature of the invention. An oblique striker surface 86, preferably, is provided at sliding door engaging end 82 of latch 70. Oblique striker surface 86 provides for a situation in which sliding door 40 is open for platform boarding, and trap door is removed in anticipation of a subsequent stop requiring ground level boarding.

FIG. 17 illustrates pin 42 on sliding door 40 moving in door closing direction 45, so as to contact oblique striker surface 86 on sliding door engaging end 82 of latch 70. In FIG. 18, pin 42, as it contacts oblique striker surface 86, rotates latch 70 counter to the bias direction 74 of torsion spring 72, thus enabling pin 42 to be captured by sliding door engaging notch 84 in latch 70.

Figure 20:
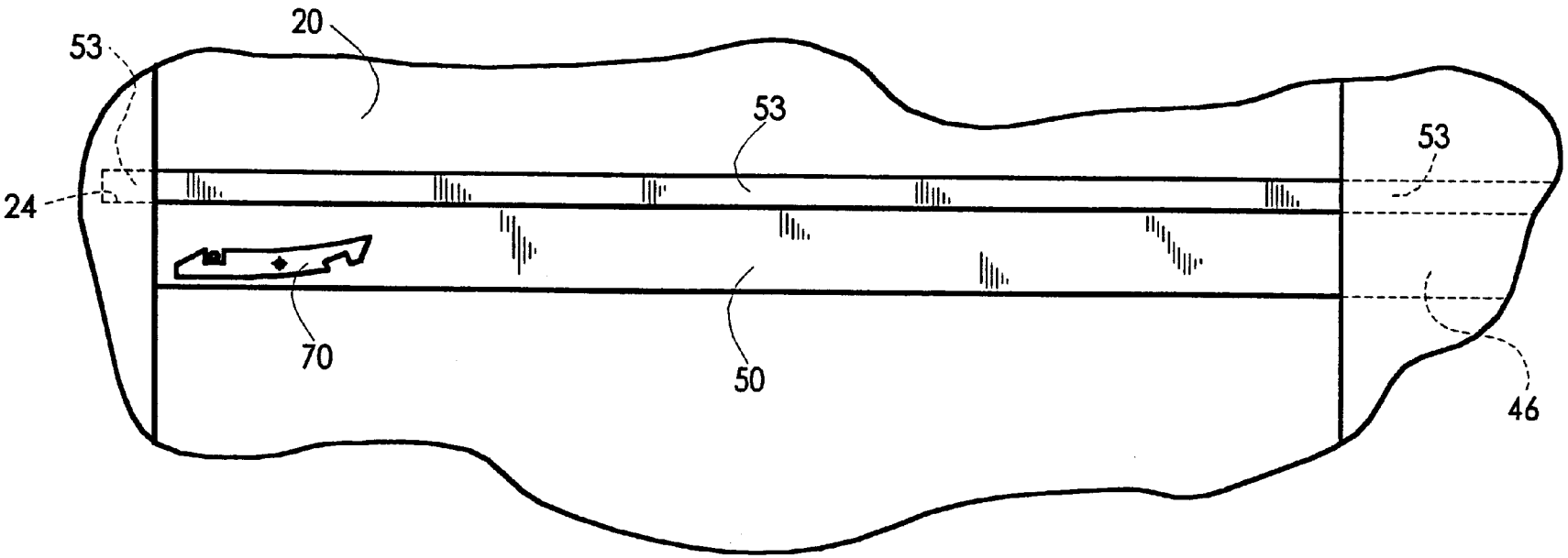
FIG. 20 is a view illustrating support of the threshold when it is in position across the door opening.

FIG. 20 illustrates the support of threshold 50 when trap door 14 is deployed and sliding door 40 has been opened for platform boarding. Preferably, top flange 53 of threshold 50 contacts support surface 24 in vehicle body 20. Top flange 53 is also supported on support 46 in sliding door 40.

While a presently preferred embodiment of the instant invention has been described in detail above in accordance the patent statutes, it should be recognized that various other modifications and adaptations of the invention may be made by those persons who are skilled in the relevant art without departing from either the spirit of the invention or the scope of the appended claims. In particular, many different configurations could be employed for retention mechanism 70, which determines whether threshold 50 moves with sliding door 40 or remains in place across door opening 22.

We claim:

1. A door system in a transit vehicle having a vehicle body with a full height door opening, the door opening enabling alternative boarding from ground level and from a platform, the transit vehicle having a floor, a stairway for ground level boarding and a trap door positionable in a deployed position for covering the stairway for platform boarding, the trap door further being positionable in a stowed position not covering the stairway for ground level boarding, said door system comprising:

a sliding door for covering and uncovering the door opening;

a threshold disposed within said sliding door when said sliding door is closed, said threshold disposed at substantially an elevation of said floor; and a retention mechanism attached to said threshold, said retention mechanism being configured to be activated when the trap door is in said deployed position to engage the trap door and release said sliding door so that when said sliding door is opened, said threshold is retained to fill a gap between the trap door and the platform, said retention mechanism being configured to disengage the trap door and engaging said sliding door when the trap door is in the stowed position so that said threshold moves with said sliding door and does not interfere with street level boarding.

2. A door system, according to claim 1, wherein said threshold has a top surface substantially at an elevation of the trap door when the trap door is in said deployed position.

3. A door system, according to claim 2, wherein said threshold has at least one stiffening rib on an underside of said threshold.

4. A door system, according to claim 3, wherein said threshold includes two stiffening ribs.

5. A door system, according to claim 1, wherein said threshold engages the vehicle body at a vehicle body engaging end of said threshold and engages said sliding door at a sliding door engaging end of said threshold when the trap door is deployed and said door is opened whereby said threshold is supported.

6. A door system, according to claim 1, wherein said threshold includes an electric heater for melting at least one of snow and ice.

7. A door system, according to claim 4 wherein said threshold further includes an electric heater disposed between said stiffening ribs for melting at least one of snow and ice.

8. A door system, according to claim 1, wherein said retention mechanism includes:

a latch pivotally attached to said threshold, said latch having a trap door engaging portion and a sliding door engaging portion, said latch being rotated by the trap door when such trap door is deployed whereby said latch releases said sliding door and engages the trap door so said threshold remains in place to fill said gap.

9. A door system, according to claim 8, wherein said latch is spring loaded to engage said sliding door so that when the trap door is not in said deployed position, said threshold remains connected to said sliding door to move with said sliding door.

10. A door system, according to claim 8, wherein said retention mechanism further includes a pin on said sliding door for engaging said sliding door engaging portion of said latch.

11. A door system, according to claim 8, wherein said retention mechanism further includes a pin attached to the trap door for engaging said trap door engaging portion of said latch.

12. A door system, according to claim 1, wherein said retention mechanism includes a latch attached to said threshold at a pivot disposed in a central portion of said latch, said latch having a trap door engaging portion at a trap door engaging end of said latch and a sliding door engaging portion at a sliding door engaging end of said latch.

13. A door system, according to claim 12, wherein said latch is spring loaded to rotate in a bias direction to engage said trap door when the trap door is in said deployed position and to engage said sliding door when the trap door is out of said deployed position.

14. A door system, according to claim 13, wherein said sliding door engaging portion of said latch includes a sliding door engaging notch for engaging a pin on said sliding door.

15. A door system, according to claim 14, wherein said sliding door engaging portion of said latch includes an oblique striker surface disposed on said sliding door engaging end of said latch, said oblique striker surface for contacting said pin on said sliding door to rotate said latch oppositely to said bias direction of said spring to permit said pin on said sliding door to enter said sliding door engaging notch provided the trap door has been removed from said deployed position.

16. A door system, according to claim 13, wherein said trap door engaging portion of said latch includes a trap door engaging notch for engaging a pin attached to the trap door.

17. A door system, according to claim 16, wherein said trap door engaging portion of said latch includes an oblique striker surface disposed at said trap door engaging end of said latch, said oblique striker surface for contacting said pin on said trap door to rotate said latch oppositely to said bias direction of said spring to permit said pin on the trap door to enter the trap door engaging notch provided the trap door is in said deployed position when said sliding door is closed.

18. A door system, according to claim 14, wherein said threshold further includes a push surface to be engaged by said pin on said sliding door to move said threshold into engagement with the trap door when the trap door is in said deployed position and said door is closed.

* * * * *